United States Patent [19]

Bron

[11] 4,215,708

[45] Aug. 5, 1980

[54] CIGARETTEPIPE WITH PURIFIER

[76] Inventor: Evert J. S. Bron, Scholeksterlaan 54, Sneek, Netherlands

[21] Appl. No.: 880,720

[22] Filed: Feb. 23, 1978

[30] Foreign Application Priority Data

Mar. 2, 1977 [NL] Netherlands ..... 7702210

[51] Int. Cl.[2] ..... A24F 13/04

[52] U.S. Cl. ..... 131/262 B; 131/200

[58] Field of Search ..... 131/187, 170 A, 262 R, 131/262 B, 194, 200; 422/174, 180

[56] References Cited

U.S. PATENT DOCUMENTS

| | | | |
|---|---|---|---|
| 1,881,793 | 10/1932 | Mariani | 131/194 |
| 2,940,835 | 6/1960 | Scofield | 422/180 X |
| 2,974,669 | 3/1961 | Ellis | 131/262 B |
| 4,077,784 | 3/1978 | Vayrynen | 131/187 X |

*Primary Examiner*—Stephen C. Pellegrino

*Attorney, Agent, or Firm*—J. Harold Nissen

[57] ABSTRACT

Pipe for cigarettes, cigars and other tobacco articles, provided with a holder with a receiving hollow at one end for the cigarette, that is connected through a smoke channel with a mouthpiece at the other end of the holder, an apparatus being fixed in the smoke channel for purifying the smoke, said apparatus comprising a catalytic afterburner for the complete smoke flow with which the incompletely burnt hydrocarbons and carbon monoxide are being burnt more completely, the nicotine and tar contents being reduced substantially, said afterburner having a catalytic operation, and comprises an electric incandescent body.

15 Claims, 1 Drawing Figure

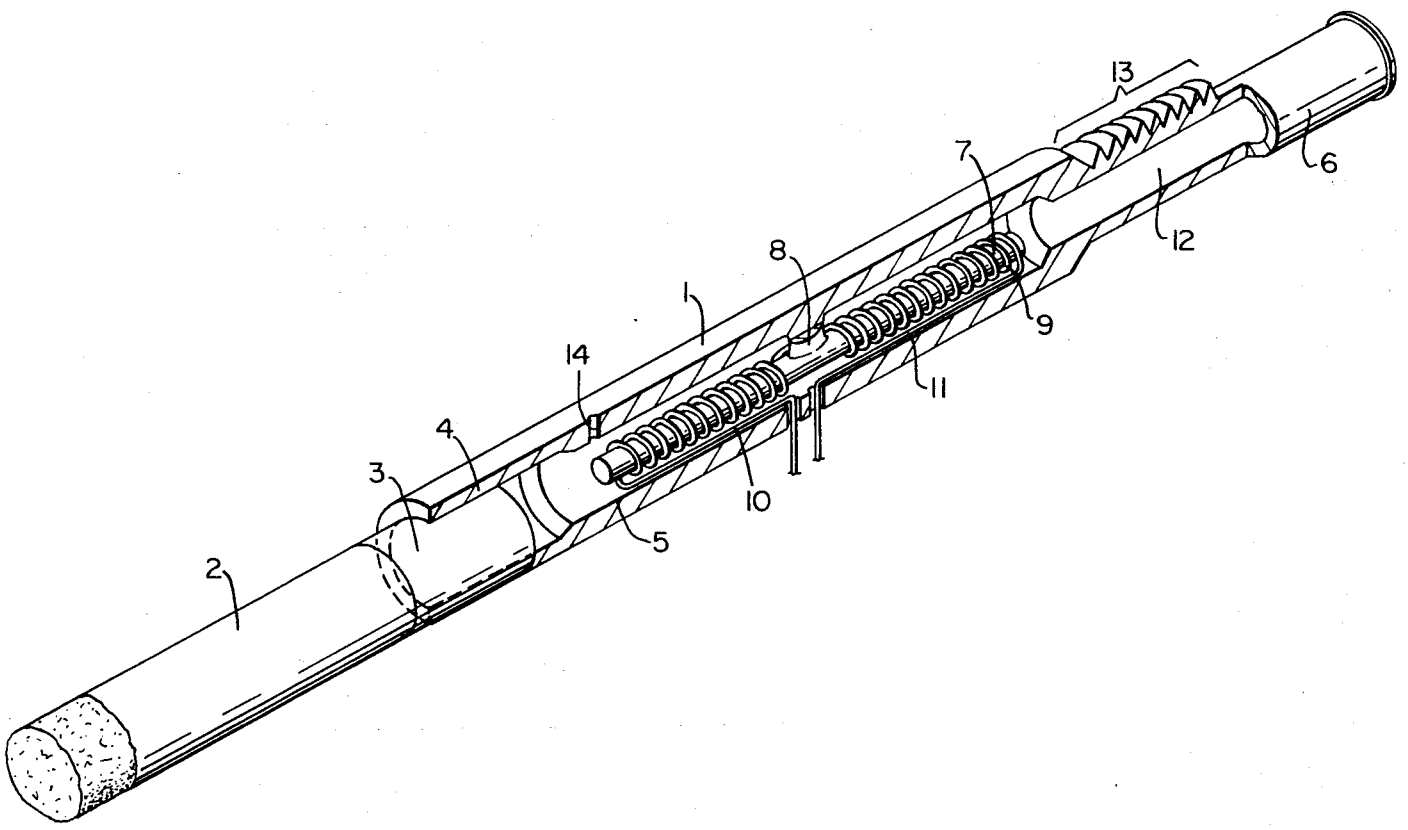
6
12
13
9
7
11
8
10
1
5
14
4
3
2

CIGARETTEPIPE WITH PURIFIER

The invention relates to a pipe for cigarettes, cigars and other tobacco articles, provided with a holder with a receiving hollow at one end for the cigarette, that is connected through a smoke channel, with a mouth piece at the other end of the holder, an apparatus being fixed in the smoke channel, for purifying the smoke.

Pipes of this kind are known in practice and usually comprise a purifying apparatus in the shape of a cartridge which comprises a filter or active carbon, with which the smoke is purified. Such a purification stops tar and nicotine in some degree, but other harmful substances such as certain hydrocarbons and carbon monoxide pass in an unsufficiently burnt condition and therefore have a harmful influence on the health of the smoker and may cause lung and heart diseases, the carbon monoxide having a stronger affinity to red blood corpuscle than oxygen, which is necessary for life functions.

The aim of the invention is abolishing this drawback and supplying a pipe, the purifying apparatus of which burns the unsufficiently burnt hydrocarbons and carbon monoxide in a more complete way.

According to the invention this aim is obtained in that the apparatus purifying the smoke comprises an after burner for the complete smoke flow with which the incompletely burnt hydrocarbons and carbon monoxide are being burnt more completely, the percentage of nicotine and tar being reduced substantially.

According to a preferred embodiment of the invention the after burner has a catalytic function. This catalytic function gives a further enlargement of the after burning, as a result of which the treated smoke flow contains smaller percentages of harmful substances, with which the nicotine may disappear completely and the carbon monoxide becomes almost negligible.

According to another embodiment of the invention the after burner comprises an electric incandescent body that may have different shapes such as a spiral, a grating or gauze or a sintered material.

A pipe for cigarettes or pipe tobacco is known from the U.S. Pat. No. 2,104,266 by which no burning of the tobacco takes place but the nicotine is distilled from the tobacco by means of electrically supplied heat, by means of which it is tried to obtain a replacement for smoking. The temperature corresponds accurately with the evaporation temperature of nicotine and is about 200°/225° C. This method does not result in a purification of the tobacco smoke.

From the German patent 198,204, dated 1907, a tobacco pipe is known with a head which has a coating at the inner wall of carbon, graphite or a similar porous substance which is impregnated with an oxidizing metal alloy as for instance platinum oxyde. In this way the smoke comes in contact with the platinum salts, which are in the wall of the pipe, so that its useful effect is very small.

Furthermore cigarettes are known from the Dutch patent No. 100,141 by which the paper of the case is impregnated with platinum salt. In this way the smoke gases only come in contact with the platina salt at the paper wall, however over here flows just a small percentage of the smoke gases, the incandescent temperature being too low for a complete transformation.

From the German patent 124,523, dated 1901, a filter for tobacco smoke is known that may be impregnated with a solution of one or more nicotine binding acids and also with a moderate solution of platinum salt. A favourable effect is hardly obtained as the platinum salt does not reach a higher temperature, the catalytic effect being very incomplete.

All these known proposals however lack a metallic catalytic surface that can react more easily with the harmful substances, by which the effect of these well known proposals stays very small.

The invention will now be clarified according to enclosed drawing in diagram of some embodiments.

The drawing shows a pipe 1 for a cigarette 2, of which the tip 3, which has a filter of its own or not, is put in the holder 4 of pipe 1. This holder 4 is connected through a smoke channel 5 with the tip 6, which is at the other end of the pipe 1. In the smoke channel 5 a holder 7 made of heat resistant material, as for instance porcelain, has axially been placed through an arrangement 8. An incandescent spiral is wound around the cylindrical holder 7, which is connected by means of electrical conductors 10 and 11 with a (not shown) source of electrical current. This source of electrical current can be arranged outside of the cigarette pipe 1, but it is also possible to arrange inside the pipe one or more batteries that may or may not be rechargeble for the electrical supply of the incandescent spiral.

The spiral 7 delimits a preferably spiral shaped room together with the outer wall of the cylindrical holder and the inner wall of the smoke channel 5, which the smoke gases have to pass and in which they come into close contact with the metal incandescent spiral 9, which comprises a platinum composition or alloy, as a result of which a catalytic afterburning takes place, by which the incompletely burnt hydrocarbons and carbon monoxyde is transformed more completely and the contents of nicotine and tar are reduced substantially.

The temperature of the incandescent body is preferably between 600° and 750° C., the maximum value being limited by the melting temperature of the incandescent body.

After flowing through the space for afterburning the smoke gases pass to the cooling space 12 as a result of which they do not arrive at the mouth of the user too hot. In order to improve the cooling effect the outer wall can be provided with outside cooling ribs 13, whereas the tip 6 might be lengthened as well.

According to another embodiment of the invention a capillary 14 has been arranged to the front side of the smoke channel 5, that connect the open air and the smoke channel 5. Through this capillary 14 open air full of oxygen can be added, resulting in diluting the smoke gases on one hand and promoting the afterburning of the smoke gases on the other hand. This capillary mainly has the same sucking resistance as a cigarette, which amount to approximately 20 cm wc, as a result of which the fall in pressure over the capillary is similar to the fall in pressure over a cigarette or over another smoking article.

As the incandescent spiral does not have to glow continuously, but exclusively when the smoker sucks at the cigarette, pipe or cigar, according to another embodiment of the invention a vacuum switch (not shown) is arranged at the capillary 14, which switches on the electric current to the incandescent body by means of a relay (not shown), resulting in a cut of electricity, which is important especially for mobile smokers, with which the electric current supply can be obtained from one or more batteries. With stationary smokers the electric current can be obtained from a transformer which connected to the a.c. mains or from a d.c. car battery in a motor car or bus.

The incandescent body 9 does not have to be a spiral, but also may exist of wool, a grating or gauze, or of a sintered material, that can be made to glow. At that the carrying body 7 with the arrangement 8 can be taken off as well.

Besides platinum one or more chromium, vandium, copper or nickel compositions can be applied as catalytic material.

Although the shown embodiment relates to a cigarette pipe, the invention applies to pipes for cigars, tobacco pipes and other tobacco articles as well. With tobacco pipes the catalytic apparatus purifying the smoke is arranged after the head in the stem of the pipe.

The embodiments of the invention in which an exclusive privilege or property is claimed are defined as follows:

1. A pipe for use in connection with the smoking of cigarettes, cigars and other tobacco articles, said pipe having:

a receiving hollow at one end to receive the article to be smoked;

a mouthpiece;

a smoke channel communicating said mouthpiece with said receiving hollow; and an apparatus fixed in said smoke channel to purify the smoke; said apparatus for purifying the smoke comprising catalytic afterburner means operable to catalytically oxidize incompletely burned hydrocarbons and carbon monoxide and to reduce, substantially, the percentage of nicotine and tar in the smoke passing through said catalytic afterburner means;

said catalytic afterburner means comprising a spiral-shaped catalyst extended in the direction of flow of smoke and disposed in said smoke channel in the path of smoke passing therethrough, to force the smoke to flow in contact with said spiral shaped catalyst along an extended path.

2. The pipe according to claim 1, wherein said afterburner means is an electrically heated incandescent spiral body.

3. The pipe according to claim 2, further comprising a source of electric current, said source of electric current being operably connected across said incandescent body thereby to generate heat in said incandescent body.

4. The pipe according to claim 3 wherein said incandescent spiral body is fixed around a cylindrical support made of heat resistant material.

5. The pipe according to claim 3 wherein said incandescent spiral body and the inner wall of said smoke channel define, therebetween, a spiral shaped space through which the smoke is constrained to flow.

6. The pipe according to claim 1 or 2 further comprising a smoke cooling chamber disposed downstream of said catalytic afterburner means and operable to partially cool gases passing therethrough.

7. The pipe according to claim 1, wherein said afterburner means is electrically heated, further comprising a source of electric current disposed outside said pipe, and electrical connectors connecting said source to said afterburner means.

8. The pipe according to claim 1 wherein said afterburner means is electrically heated, further comprising a source of electric current disposed inside said pipe.

9. The pipe according to claim 7 or 8 further comprising a vacuum switch and a relay, said vacuum switch being operable to switch the relay upon application of a vacuum caused by the sucking of the person smoking the cigarette, said relay being connected between the source of electric current and the catalytic afterburner to switch the source of electric current for the mobile smoker during each suck of 2 seconds duration.

10. The pipe according to claim 3, 2, 7 or 8 wherein said afterburner means comprises a platinum, chromium or vanadium composition or alloy.

11. The pipe according to claim 3 or 8 wherein said source of electric current for the stationary smoker comprises an electric transformer.

12. The pipe according to claim 6 wherein said cooling chamber comprises heat exchange fins disposed on the outside thereof.

13. The pipe according to claim 1 or 2 further including a capillary inlet passage disposed through the wall of said pipe, upstream of said incandescent body means and having substantially the same sucking resistance as the cigarette (20 cm wc), the fall of pressure over the capillary being similar or equal to that across a cigarette or other smoking article, to provide additional air to the smoke stream without substantially affecting the smoking comfort of the person using the pipe.

14. The pipe according to claim 1 or 2 wherein the catalytic afterburner means further comprises a catalyst support, said spiral-shaped catalyst being spiraled about said support to fill a major cross-sectional portion of the smoke channel and constrains the smoke to an extended spiral path in contact with said spiral-shaped catalyst, thereby to ensure that substantially all of the smoke passing through the channel contacts said spiral-shaped catalyst.

15. In a pipe for use in connection with the smoking of cigarettes, cigars and other tobacco articles, said pipe having a receiving hollow at one end to receive the article to be smoked; a mouthpiece at the other end, and a smoke channel communicating said mouthpiece with said receiving hollow; the improvement comprising in combination:

an apparatus fixed in said smoke channel to purify the smoke, said apparatus for purifying the smoke comprising catalytic afterburner means operable to catalytically oxidize incompletely burned hydrocarbons and carbon monoxide and to reduce, substantially, the percentage of nicotine and tar in the smoke passing through said catalytic afterburner; and, a capillary inlet passage disposed through the wall of the pipe upstream of the catalytic afterburner and having substantially the same sucking resistance as a cigarette (20 cm wc), the fall in pressure over the capillary being similar or equal to a cigarette or another smoking article, to provide additional air to the smoke stream without substantially affecting the smoking comfort of a person using the pipe.

* * * * *